106-85 AU 115 EX
6/6/78 XR 4,093,467

United States Patent [19]
Lyass et al.

[11] 4,093,467
[45] June 6, 1978

[54] METHOD FOR MAKING FOUNDRY MOULDS AND CORES

[76] Inventors: Abram Moiseevich Lyass, Sharikopodshipnikovskaya ulitsa, 2, kv. 146; Sergei Semenovich Zhukovsky, Profsojuznaya ulitsa, 17, korpus 1, kv. 15; Sergei Dmitrievich Teplyakov, Seleznevskaya ulitsa, 13, kv. 3, all of Moscow, U.S.S.R.

[21] Appl. No.: 680,923

[22] Filed: Apr. 28, 1976

Related U.S. Application Data

[63] Continuation of Ser. No. 435,019, Jan. 21, 1974, abandoned, which is a continuation of Ser. No. 306,336, Nov. 13, 1972, abandoned, which is a continuation of Ser. No. 131,533, Apr. 5, 1971, abandoned.

[51] Int. Cl.[2] ..... B28B 7/34
[52] U.S. Cl. ..... 106/38.35; 106/38.3; 106/38.9; 106/85; 164/41

[58] Field of Search ..... 106/38.3, 38.35, 38.9, 106/85, 286; 164/41

[56] References Cited

U.S. PATENT DOCUMENTS

| | | | |
|---|---|---|---|
| 2,368,322 | 1/1945 | Passelecq | 106/38.35 |
| 2,522,548 | 9/1950 | Streicher | 106/38.9 |
| 2,926,098 | 2/1960 | Ilenda et al. | 106/38.35 |

*Primary Examiner*—Lorenzo B. Hayes
*Attorney, Agent, or Firm*—Holman & Stern

[57] ABSTRACT

A method for making foundry moulds and cores, according to which a self-hardening in the air plastic or liquid mixture is employed. Most advantageously the present invention may be used in making large-size foundry moulds and cores. The proposed method tends to increase substantially the thermal stability of both the moulds and cores due to the effect which the properties of the materials, utilized as a binder, exert on the sand. In addition, the hardening rate of the mixture is increased which is coupled with the simplified knocking-out of the sand from castings.

10 Claims, No Drawings

METHOD FOR MAKING FOUNDRY MOULDS AND CORES

This is a continuation of application Ser. No. 435,019 filed Jan. 21, 1974 which in turn is a Continuation of U.S. Ser. No. 306,336 filed Nov. 13, 1972, which in turn is a continuation of U.S. Ser. No. 131,533, filed Apr. 5, 1971, now both abandoned.

BACKGROUND OF THE INVENTION

The present invention relates to foundry work and particularly to the art of producing foundry moulds and cores by using self-hardening plastic or liquid moulding sand mixtures.

Most efficiently the present invention may be used in manufacturing heavy foundry moulds and cores.

The use of such moulds and cores, produced by the known procedure, presents a problem arising from the fact that both the moulds and cores are susceptible to deformation at high temperatures. This is displayed, for example, in using a mixture of refractory pulverized material, such as highsilica sand, olivine or zircon, which act as a filler, and is hereinafter referred to as a moulding sand, sodium silicate as a binder and bicalcium silicate or materials containing the foregoing compound. In addition, the sand is tempered with water and a foaming agent may also be used (see, for example, French Pat. No. 1,342,529, British Pat. No. 1,085,651, and German Provisional Specification No. 1,249,461). The method involves a number of operations associated with the shaping of foundry moulds and cores from the sand obtained and with their weathering to be hardened. Hardening time is rather long ranging from 40 to 50 min. Compressive strength of the moulds and cores produced does not exceed 1.5–2.0 kg/cm$^2$.

SUMMARY OF THE INVENTION

It is an object of the present invention to eliminate the above drawbacks.

The present invention is, in essence, aimed at developing a technique for making foundry moulds and cores from selfhardening in the air moulding sand in which the presence of a binder ensures a substantial enhancement of the physical and mechanical properties of the moulds and cores.

According to the invention, ortho-phosphoric acid and ferrous oxide or a material with a ferrous oxide content of not less than 30% may be used as a binding agent. As a result of the reaction which takes place between ortho-phosphoric acid and ferrous oxide, foundry moulds and cores featuring high strength may be produced. Also, a considerably higher rate of hardening is feasible. The operations and their sequence, envisaged by the process of the invention, are similar to the foregoing procedure.

The best results are achieved with an ortho-phosphoric acid content ranging from 2.0 to 10.0% of the weight of the moulding sand.

It would be sound practice to employ iron scales as the sand constituent containing the ferrous oxide. Being the most widely spread material the scale contains a large amount of ferrous oxide (up to 70%).

A ferrous oxide content constituting from 1.5 to 6.0% of the weight of the moulding sand is considered the most suitable for the binders.

The strength of the foundry moulds and cores may be further increased by adding to the binder either the oxides or hydroxides of a metal such as calcium, cadmium, zinc or copper.

As experiments have shown, an oxide or hydroxide content of from 0.005 to 0.12% of the weight of the moulding sand is sufficient for moulding purposes.

The use of the above constituents makes it possible to produce plastic moulding sands. Where use is made of a binder containing a foaming agent as an additional ingredient, liquid moulding sands are obtained. The most suitable foaming agent is sodium alkyl aryl sulfonate, e.g,, of butyl napht-halene sulfonic acid. From 0.1 to 1.0% (of the weight of the moulding sand) of the salt is quite sufficient.

By using polyhydric aliphatic alcohol it is possible to obtain plastic moulding sand possessing the same properties as the mixture with the oxide or hydroxide of the above metals. Ethylene glycol, diethylene glycol or glycerine may be employed as said laternatives to the alcohol. The required effect may be obtained with an alcohol content amounting to 0.5–3.0% of the weight of the moulding sand.

The ferrous oxide is added to the mixture in a finely pulverized form. Grain fineness number or specific surface area, determined by filtration of air through a layer of the pulverized ferrous oxide and calculated by the Koseny-Karman method, varied from 500 to 3000 cm$^2$/g. In addition, the larger the specific surface area, the higher was the mixture hardening rate and the strength of moulds and cores produced. Use may be made not only of ferrous oxide, but also of various concentrates of magnetite, ilmenite and siderite ores as well as chrome iron ore. However in using the above materials both the strength of the sand and its hardening rate depend on the ferrous oxide content of the foregoing materials. Naturally, the larger the percentage of ferrous oxide in these materials, the higher is the strength and hardening rate of the sand.

The concentration of the ortho-phosphoric acid may vary within 30–80%. It should be kept in mind, however, that the higher concentration of the acid results in an increased strength and hardening rate of the sand.

An essential advantage of the present invention lies in the fact that the thermal stability of the foundry moulds and cores is from 2 to 3 times greater and is accompanied by a 4 to 5 fold increase in the hardening rate.

Knocking-out of the hardened sand mixture from castings is greatly simplified.

DETAILED DESCRIPTION OF THE PREFERRED EMBODIMENT

Outlined below are exemplary embodiments of the method of the invention.

EXAMPLE 1

92.0 parts by weight of moulding sand were mixed for 1–2 min. with 8.0 parts by weight of finely pulverized iron scale which had a specific surface area of 2000 cm$^2$/g and a ferrous oxide content of 50%. Next, 5.0 parts by weight of 40% ortho-phosphoric acid were added to the above mixture of dry components. Upon mixing for 1 min a plastic moulding sand was obtained which served for making a core or a mould by the application of the known technique, whereupon the core or mould was left in the air for hardening, which took place within 3 min.

After 1-hr hardening the compressive strength of the sand was equal to 5.0 kg/cm$^2$, whereas after 23-hrs it amounted to 7.0 kg/cm$^2$.

EXAMPLE 2

94.5 parts by weight of moulding sand were mixed for 1 to 2 min. with 5.5 parts by weight of finely pulverized iron scales possessing a specific surface area of 2000 $cm^2/g$ with a ferrous oxide content of 50%. Upon blending, the mixture of dry ingredients was mixed for 1 to 1.5 min. with 8.0 parts by weight of 35% ortho-phosphoric acid and 0.15 part by weight of sodium salt of butyl naphthalene sulfonic acid, whereupon stirring proceeded for 1–15 min. The liquid mixture obtained herewith possessed 13-min. foam stability. The mixture was poured into core boxes or on patterns and weathered for hardening which occurred within 20 min.

After 1-hr hardening the compressive strength of the sand amounted to 5.0 $kg/cm^2$, while after 24 hours it reached 10 $kg/cm^2$.

EXAMPLE 3

92 parts by weight of moulding sand were mixed for 1 to 2 min. with 8.0 parts by weight of finely ground iron scales which possessed a specific surface area of 2000 $cm^2/g$ with a 50% content of ferrous oxide. The blend was mixed for 1 min. with 5.0 parts by weight of 40% ortho-phosphoric acid and 0.01 part by weight of cadmium oxide. The plastic sand obtained was employed for making a core or a mould by using the known procedure with the core or mould being left in the air for hardening. The core or the pattern could be removed from the mould within 7 min.

The compressive strength of the moulding sand after 1-hr hardening amounted to 7.5 $kg/cm^2$ and after 24 hrs to 16 $kg/cm^2$.

EXAMPLE 4

94.5 parts by weight of moulding sand were mixed for 1 to 2 min with 5.5 parts by weight of finely divided iron scales having a specific surface area of 1700 $cm^2/g$ with a ferrous oxide content of 50%. The blend of dry components was mixed with 8.0 parts by weight of 53% ortho-phosphoric acid, 0.01 part by weight of copper oxide and 0.15 part by weight of sodium salt of butyl naphthalene sulfonic acid. Upon blending, which proceeded for 1–1.5 min., a liquid mixture with 10-min. foam stability was produced. The mixture was poured in core boxes or on patterns and left for weathering. Hardening took place within 15 min.

The compressive strength of the sand after hardening for 1 hr was equal to 7.0 $kg/cm^2$, whereas after 24 hours it amounted to 13 $kg/cm^2$.

EXAMPLE 5

92.0 parts by weight of moulding sand were blended for 1 to 2 min. with 8.0 parts by weight of finely pulverized iron scales possessing a specific surface area of 2000 $cm^2/g$ with a ferrous oxide content of 50%. The blend of dry ingredients was mixed with 2.7 parts by weight of 80% ortho-phosphoric acid and 2.3 parts by weight of ethylene glycol. Upon blending for 1 min., a plastic sand was obtained which was employed for making a core or a mould by using the known technique. The core or mould was then weathered for hardening which occurred after 5 min.

After hardening for 1 hr. the compressive strength of the mixture amounted to 8 $kg/cm^2$ and after 24 hrs. to 14 $kg/cm^2$.

What is claimed is:

1. A method for making foundry moulds and cores which comprises preparing a mixture made up of from 94.0 to 98.5 parts by weight of moulding sand, from 2.0 to 10.0 parts by weight of ortho-phosphoric acid and a requisite amount of a material containing not less than 30% of ferrous oxide, so that the mixture obtained contains from 1.5 to 6.0 parts by weight of ferrous oxide, shaping the moulds and cores obtained from the moulding mixture and holding them in the air for hardening.

2. The method as claimed in claim 1, in which iron scale is used as the ferrous-oxide-containing material.

3. The method as claimed in claim 1, in which the mixture contains a foaming agent.

4. The method as claimed in claim 3, in which the weight of the foaming agent constitutes from 0.1 to 1.0% of that of the moulding sand.

5. The method as claimed in claim 3, in which the foaming agent is sodium alkyl aryl sulfonate.

6. A method for making foundry moulds and cores which comprises preparing a mixture made up of from 94.0 to 98.5 parts by weight of moulding sand, from 2.0 to 5.0 parts by weight of ortho-phosphoric acid and a requisite amount of a material containing not less than 30% of ferrous oxide, so that the blend obtained contains from 1.5 to 6.0 parts by weight of ferrous oxide and from 0.005 to 0.1 part by weight of at least one of the materials selected from the group consisting of oxides or hydroxides of calcium, cadmium, zinc or copper, shaping the moulds and cores produced from the mixture and weathering them for hardening.

7. The method as claimed in claim 6, in which the mixture contains a foaming agent in an amount of from 0.1 to 1.0% of the weight of the moulding sand.

8. The method as claimed in claim 7, in which sodium alkyl aryl sulfonate is employed as the foaming agent.

9. A method for making foundry moulds and cores which comprises preparing a mixture made up of from 94.0 to 98.5 parts by weight of moulding sand, from 2.0 to 5.0 parts by weight of ortho-phosphoric acid and such an amount of a material containing not less than 30% of ferrous oxide, that the blend obtained contains from 1.5 to 6.0 parts by weight of ferrous oxide and from 0.5 to 3.0 parts by weight of polyhydric aliphatic alcohol, shaping the moulds and cores obtained from the mixture and hardening the moulds and cores.

10. The method as claimed in claim 9, in which ethylene glycol, diethylene glycol, propylene glycol or glycerine may be used as alternatives to the polyhydric aliphatic alcohol.

* * * * *